US008869904B2

(12) United States Patent
Jani

(10) Patent No.: US 8,869,904 B2
(45) Date of Patent: Oct. 28, 2014

(54) RETRIEVABLE STIMULATION FRAC (RSF) PLUG

(75) Inventor: William Jani, Calgary (CA)

(73) Assignee: Sure Tech Tool Services Inc., Airdrie (CA)

( * ) Notice: Subject to any disclaimer, the term of this patent is extended or adjusted under 35 U.S.C. 154(b) by 376 days.

(21) Appl. No.: 13/183,014

(22) Filed: Jul. 14, 2011

(65) Prior Publication Data

US 2013/0014958 A1 Jan. 17, 2013

(30) Foreign Application Priority Data

Jul. 13, 2011 (CA) ..... 2746171

(51) Int. Cl.
*E21B 33/12* (2006.01)
*E21B 43/26* (2006.01)
*E21B 33/134* (2006.01)

(52) U.S. Cl.
CPC ..... *E21B 33/134* (2013.01); *E21B 43/26* (2013.01)
USPC ..... 166/386; 166/308.1; 166/117.5; 166/192

(58) Field of Classification Search
USPC ..... 166/308.1, 386, 192, 135, 118, 308, 166/177.5
See application file for complete search history.

(56) References Cited

U.S. PATENT DOCUMENTS

| | | | | |
|---|---|---|---|---|
| 6,942,039 | B2 | 9/2005 | Tinker | |
| 7,950,468 | B2 | 5/2011 | Horton | |
| 2003/0192703 | A1 * | 10/2003 | Williams et al. | 166/376 |
| 2007/0095545 | A1 * | 5/2007 | Lembcke et al. | 166/386 |
| 2011/0226478 | A1 | 9/2011 | Horton | |

* cited by examiner

*Primary Examiner* — Brad Harcourt
(74) *Attorney, Agent, or Firm* — Jackson Walker, LLP

(57) ABSTRACT

A retrievable stimulation frac (retrievable stimulation frac) plug for a well casing having an elongate mandrel having a fluid flow bore, a check valve mandrel seal moveable between an open position and a closed position for selectively sealing the fluid flow bore, a sealing mechanism for sealing between the mandrel and the casing, and a locking mechanism for axially locking the retrievable stimulation frac plug in the casing.

12 Claims, 13 Drawing Sheets

RETRIEVABLE STIMULATION FRAC (RSF) PLUG

This application claims priority from Canadian Patent Application No. 2,746,171, filed Jul. 13, 2011.

FIELD

The present disclosure relates generally to hydrocarbon well workover tools. More particularly, the present disclosure relates to zonal isolation tools for use during well workovers and methods of using the zonal isolation tools.

BACKGROUND

In cased well completion or stimulation operations, it is sometimes desirable to isolate one section or zone of the well from another. This is commonly accomplished with a "bridge plug".

It is known that certain bridge plugs may be drilled out to remove them from the well.

It is known that certain bridge plugs may be selectively activated, for example by a drop ball, introduced into the well from surface, or other plugging systems.

It is known that certain bridge plugs may be retrievable, for example by retrieval from the well bore once the stimulation operation is complete.

One typical problem with conventional retrievable bridge plugs is that debris or other materials, for example frac sand or proppant, may accumulate on the top of the plug, which may make it difficult or even impossible to latch onto the plug for retrieval. The debris or other materials, may also accumulate in the annular region between the bridge plug and the casing, and may interfere with the release of the slips or the seals or both, making retrieval of the bridge plug more difficult or even impossible.

Another typical problem with conventional retrievable bridge plugs, in a multiple zone wellbore, where multiple retrievable bridge plugs are set to isolate the respective zones, is that it may be time and labour intensive to retrieve the multiple bridge plugs, one at a time, from the wellbore.

It is, therefore, desirable to provide an improved retrievable stimulation frac plug.

SUMMARY

It is an object of the present disclosure to obviate or mitigate at least one disadvantage of previous retrievable bridge plugs.

A retrievable stimulation frac plug for a well casing includes a mandrel having a fluid flow bore, a seal for sealing between the mandrel and the casing, and an anchor for anchoring the frac plug in the casing.

A check valve operates to selectively seal off the fluid flow bore, opening to permit fluid or pressure below the frac plug to flow up through the fluid flow bore, and automatically closing to prohibit fluid or pressure above the frac plug to flow down through the fluid flow bore. The check valve includes a manual over-ride, which selectively holds the check valve in an open position.

The check valve is held in an open position when the frac plug is run into the casing, on a setting tool, and when the frac plug is retrieved from the casing, on a retrieving tool. When the frac plug is set in the casing, the check valve is allowed to operate normally, that is, as a check valve.

The retrievable stimulation frac plug may be used for stimulation-frac and production operations. Once the retrievable stimulation frac plug is set in the casing, production from below may pass through the inside diameter of the retrievable stimulation frac plug. Stimulation work may be performed above which seals the inside diameter of the retrievable stimulation frac plug, prohibiting the pressure/materials from the stimulation work to pass through the frac plug, isolating the zone below the frac plug from the zone above the frac plug.

The setting tool has a bore through to facilitate running the tool into the casing. Wellbore fluids can flow through the bore to reduce or eliminate the dragging/swabbing effect.

The retrieving tool has a bore through to facilitate circulating fluids, for example wellbore fluids, to wash the top of the frac plug prior to retrieving.

In a first aspect, the present disclosure provides a retrievable stimulation frac (RSF) plug for a well casing, having an elongate mandrel having a fluid flow bore, a one-way check valve mandrel seal moveable between an open position and a closed position for selectively sealing the fluid flow bore, a sealing mechanism for sealing between the mandrel and the casing, and a locking mechanism for axially locking the retrievable stimulation frac plug in the casing.

In an embodiment disclosed, the one-way check valve mandrel seal further includes a mechanical over-ride adapted to be actuated by a retrieving tool, to lock the one-way check valve mandrel seal in the open position.

In an embodiment disclosed, the one-way check valve mandrel seal includes a flapper. In an embodiment disclosed, the flapper is biased toward the closed position.

In an embodiment disclosed, the flapper has an extended lip adapted to urge the flapper into the open position upon engagement with a retrieving tool. In an embodiment disclosed, the extended lip is adapted to be operable by the retrieving tool, in order to retain the flapper in the open position.

In an embodiment disclosed, the retrievable stimulation frac plug further includes a setting tool, the setting tool having a shear rod extending through the fluid flow bore, retaining the mandrel seal in the open position, and a shear pin connecting the shear rod and a lower cone of the retrievable stimulation frac plug.

In a further aspect, the present disclosure provides a retrieving tool for a retrievable stimulation frac plug, the retrieving tool including an elongate mandrel having a bore therethrough, a collet retainer adapted to engage an extended lip of a flapper on a retrievable stimulation frac plug to move the flapper into an open position, and a collet adapted to engage and latch onto a catch of the retrievable stimulation frac plug.

In a further aspect, the present disclosure provides a method of stimulating a well having casing, including providing a retrievable stimulation frac plug having an elongate mandrel with a fluid flow bore; the fluid flow bore sealable with a check valve, the check valve moveable between an open position and a closed position and biased to the closed position, selectively moving the check valve into the open position; deploying the retrievable stimulation frac plug into the casing; and conducting a well operation.

In an embodiment disclosed, the check valve includes a flapper. In an embodiment disclosed, the well operation includes producing fluids from below the retrievable stimulation frac plug through the fluid flow bore, the check valve forced at least partially from the closed position by the fluids.

In an embodiment disclosed, the well operation includes frac-stimulation of the well above the retrievable stimulation frac plug, the check valve retained in the closed position by the frac-stimulation.

In an embodiment disclosed, the method includes retrieving the retrievable stimulation frac plug after conducting the well operation.

In an embodiment disclosed, the method further includes circulating fluids proximate an upper end of the retrievable stimulation frac plug prior to retrieving the retrievable stimulation frac plug.

In an embodiment disclosed, the method further includes providing a second retrievable stimulation frac plug having a second elongate mandrel with a second fluid flow bore; the second fluid flow bore sealable with a second check valve, the second check valve moveable between an open position and a closed position and biased into the closed position, providing a retrieving tool, attached below the second retrievable stimulation frac plug, selectively moving the second check valve into the open position, deploying the second retrievable stimulation frac plug into the casing, above the retrievable stimulation frac plug, and conducting a second well operation.

In an embodiment disclosed, the method further includes providing a retrieving tool on a work string, deploying the retrieving tool into the well to latch onto the second retrievable stimulation frac plug, releasing the second retrievable stimulation frac plug from the casing, further deploying the retrieving tool into the well, with second retrievable stimulation frac plug and second retrieving tool attached to latch onto the retrievable stimulation frac plug, releasing the retrievable stimulation frac plug from the casing, and pulling the work string from the well, with the second retrievable stimulation frac plug and the retrievable stimulation frac plug attached, in a single run.

Other aspects and features of the present disclosure will become apparent to those ordinarily skilled in the art upon review of the following description of specific embodiments in conjunction with the accompanying figures.

BRIEF DESCRIPTION OF THE DRAWINGS

Embodiments of the present disclosure will now be described, by way of example only, with reference to the attached Figures.

DETAILED DESCRIPTION

Generally, the present disclosure provides a method and system for isolating one section of a well from another, for example to facilitate stimulating the well.

Figure 1:
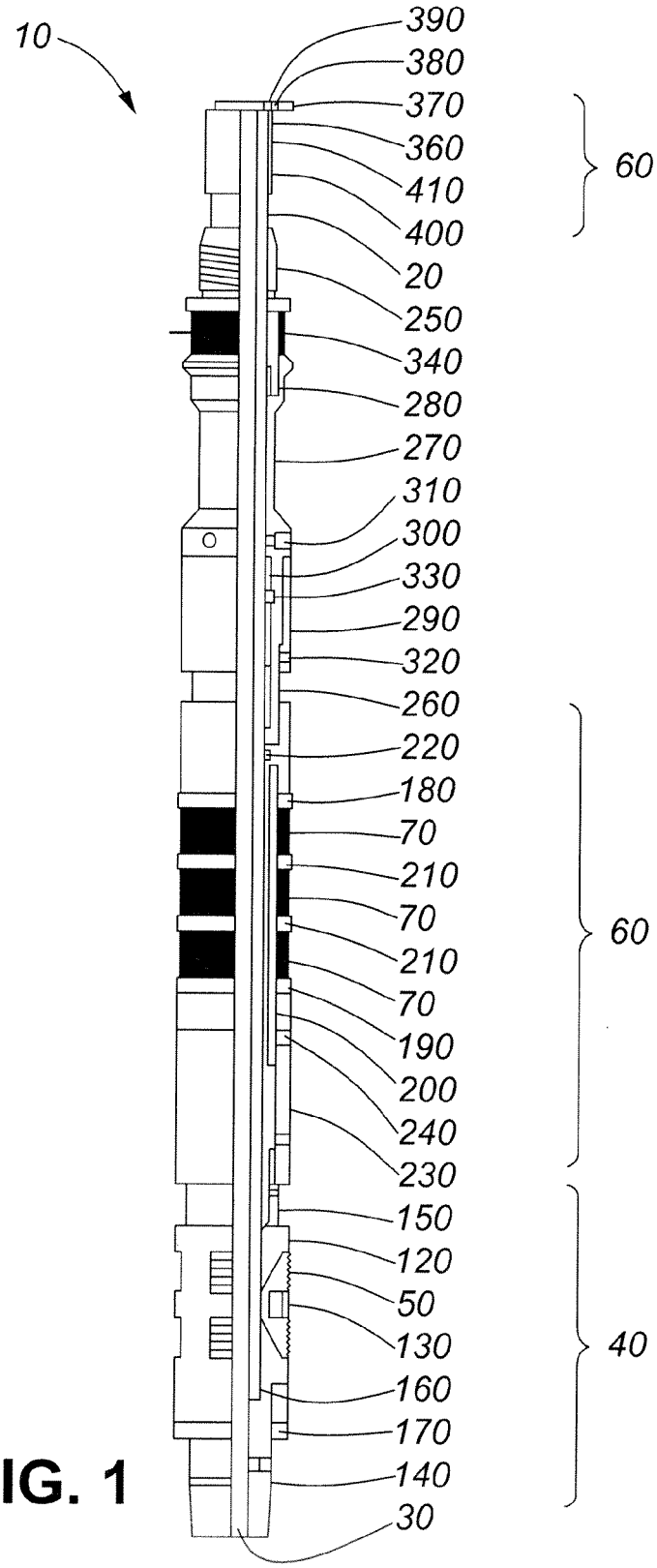
FIG. 1 is a retrievable stimulation frac plug of the present disclosure.
Figure 8:
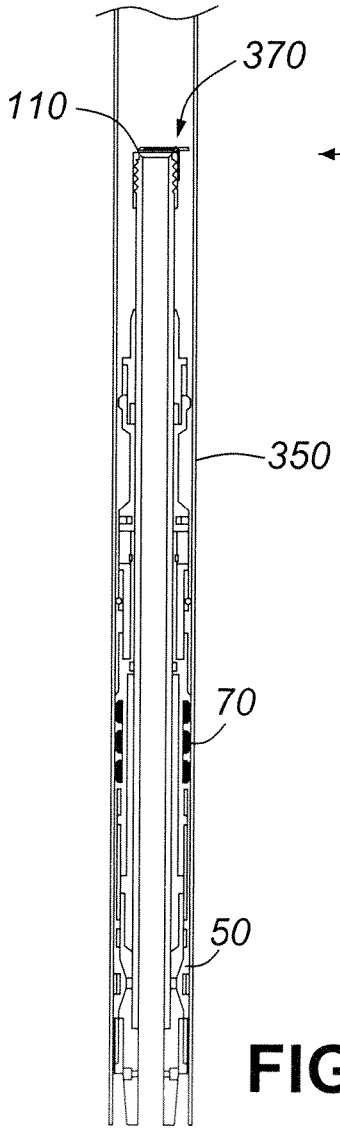
FIG. 8 is retrievable stimulation frac plug of the present disclosure depicting the plug set in place.
Figure 9:
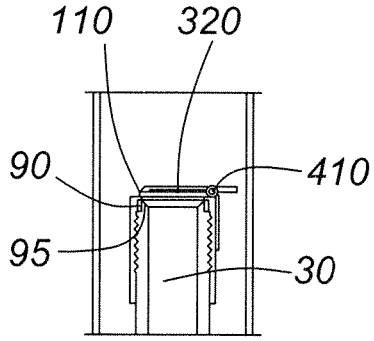
FIG. 9 is an enlarged detail of FIG. 8.

Referring to FIG. 1, retrievable stimulation frac plug 10 includes a mandrel 20 having a fluid flow bore 30 disposed therein, a slip portion 40 comprising at least one slip 50 disposed around the mandrel 20, an annular seal portion 60 comprising at least one sealing element 70 disposed around the mandrel 20, and a fluid flow bore seal portion 80 comprising at least one sealing element 90 (see FIG. 11) moveable between an open position 100 (see FIGS. 10 and 11) and a closed position 110 (see FIGS. 8 and 9).

The slip portion 40 includes slips 50 mounted within a slip cage 120, having slip springs 130 biasing the slips 50 toward the mandrel 20. The slips 50 are mounted between a lower cone 140 and upper cone 150. An o-ring 160 seals between the lower cone 140 and the mandrel 20. An end cap 170 sits between the lower cone 140 and the slip cage 120 and retains the lower cone 140.

The annular seal portion 60 includes one or more sealing elements 70 mounted between an upper gauge ring 180 and a lower gauge ring 190 on a seal mandrel 200. In an embodiment disclosed, a plurality of sealing elements 70 are used. In an embodiment disclosed, a spacer 210 sits between the sealing elements 70. An o-ring 220 seals between the mandrel 20 and the upper gauge ring 180.

A lower shear sub 230 connects the upper cone 150 of the slip portion 40 and the seal mandrel 200 of the annular seal portion 60. A shear screw 240 pins the connection between the lower shear sub 230 and the seal mandrel 200. In an embodiment disclosed, the shear screw 240 is designed to shear upon application of about a 2000 lb shear force.

A latch 250 is connected with the upper gauge ring 180 through a release shear sub 260 and an upper shear sub 270. The connection between the latch 250 and the upper shear sub 270 includes an upper ratchet 280. The connection between the upper shear sub 270 and the release shear sub 260 includes a release shear sleeve 290 and a lower ratchet 300. A snap-ring 330 engages the lower ratchet 300. A shear screw 310 pins the connection between the upper shear sub 270 and the mandrel 20. A shear screw 320 pins the connection between release shear sub 260 and the release shear sleeve 290. In an embodiment disclosed, the shear screw 310 is designed to shear upon application of about a 2000 lb shear force. In an embodiment disclosed, the shear screw 320 is designed to shear upon application of about a 2000 lb shear force.

In an embodiment disclosed, a deflector 340 proximate the latch 250 provides an annular seal between the retrievable stimulation frac plug 10 and the casing 350 (see FIG. 6), such that materials, such as sand or other proppant from stimulation operations, or other materials do not collect on top of or around the workings of the retrievable stimulation frac plug 10.

The fluid flow bore seal portion 80 includes a check valve, in the form of flapper seal 360, formed between a flapper 370 and the fluid flow bore 30 of the mandrel 20. The flapper 370 is mounted on a flapper pin 380 forming a flapper hinge 390, the flapper 370 is moveable between an open position 100 (FIGS. 10, 11) and a closed position 110 (FIGS. 8, 9). With the flapper 370 in the open position 100 (FIGS. 10, 11), the fluid flow bore 30 is open and permits fluid flow, and with the flapper 370 in the closed position 110 (FIGS. 8, 9), the fluid flow bore 30 is sealed off and does not permit fluid flow. The flapper 370 is biased toward the closed position 110 (FIGS. 8, 9) by a flapper spring 410. The flapper 370 is attached to the mandrel 20 by a seal retainer 400.

In an embodiment disclosed, the retrievable stimulation frac plug 10 may be used in vertical or horizontal wells or both.

Figure 2:
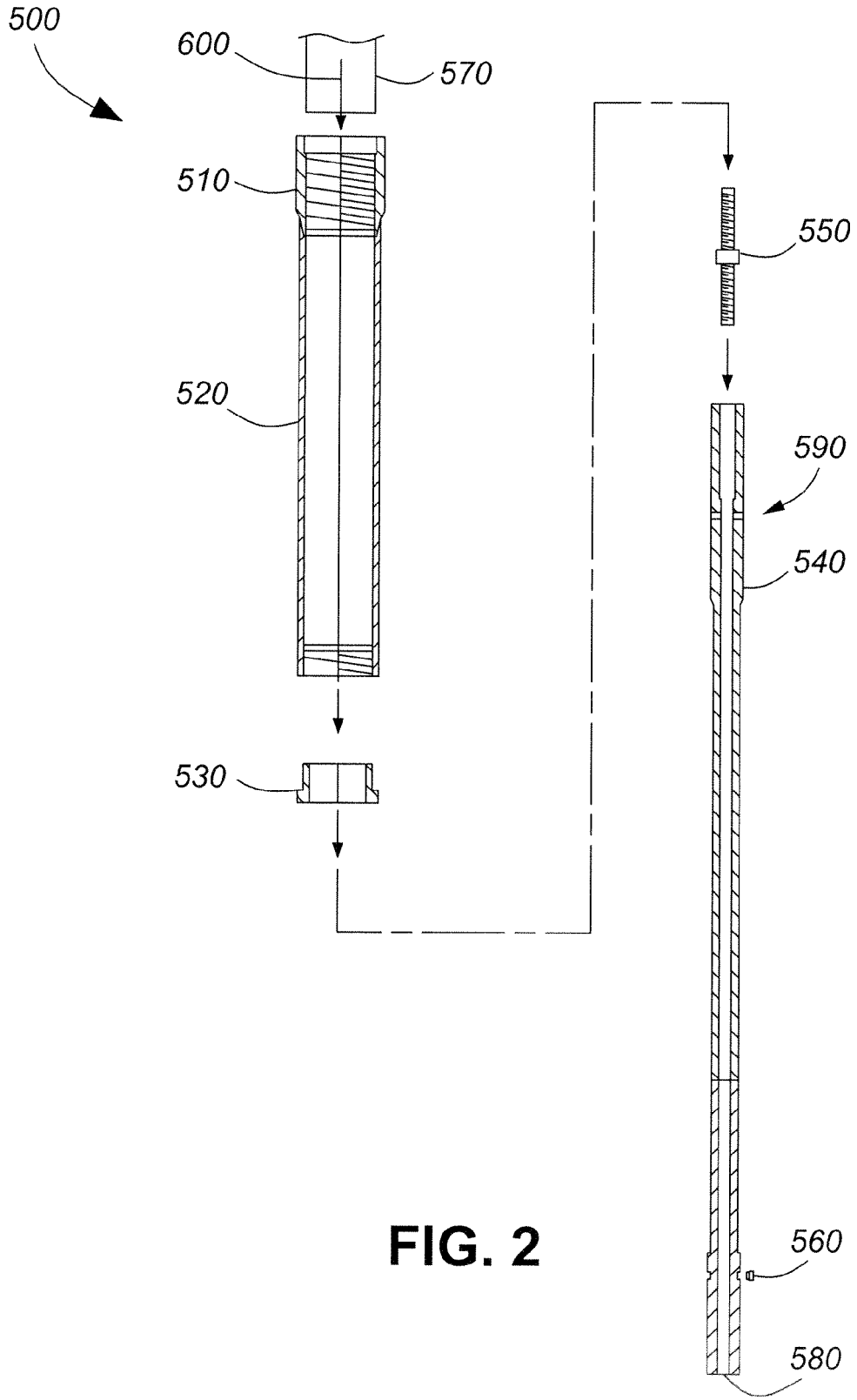
FIG. 2 is a setting tool of the present disclosure.

Referring to FIG. 2, a disclosed setting tool 500 includes a sleeve adaptor 510 for connecting the setting tool 500 and a work string 570, such as tubing, for example coiled tubing or line, such as wireline, electric line, or slickline. A setting sleeve 520 extends downward from the sleeve adapter 510 and terminates with a setting sleeve end cap 530. The setting sleeve end cap 530 is adapted to mate with, but not engage latch 250 (see also FIG. 6) of the retrievable stimulation frac plug 10.

In conjunction with the sleeve adaptor 510, a shear rod 540 having an open bore 580 is inserted through the fluid flow bore 30 of the retrievable stimulation frac plug 10 mandrel 20 (see FIG. 6) and fixed in place with a shear screw 560, and a connecting stud 550 is used to connect the shear rod 540 and a setting line 600, such as slickline or electric line or wireline. With the connecting stud 550 in the shear rod 540, the open flow path of the bore 580 is completed with one or more ports 590 extending through the wall of the shear rod 540.

Figure 3:
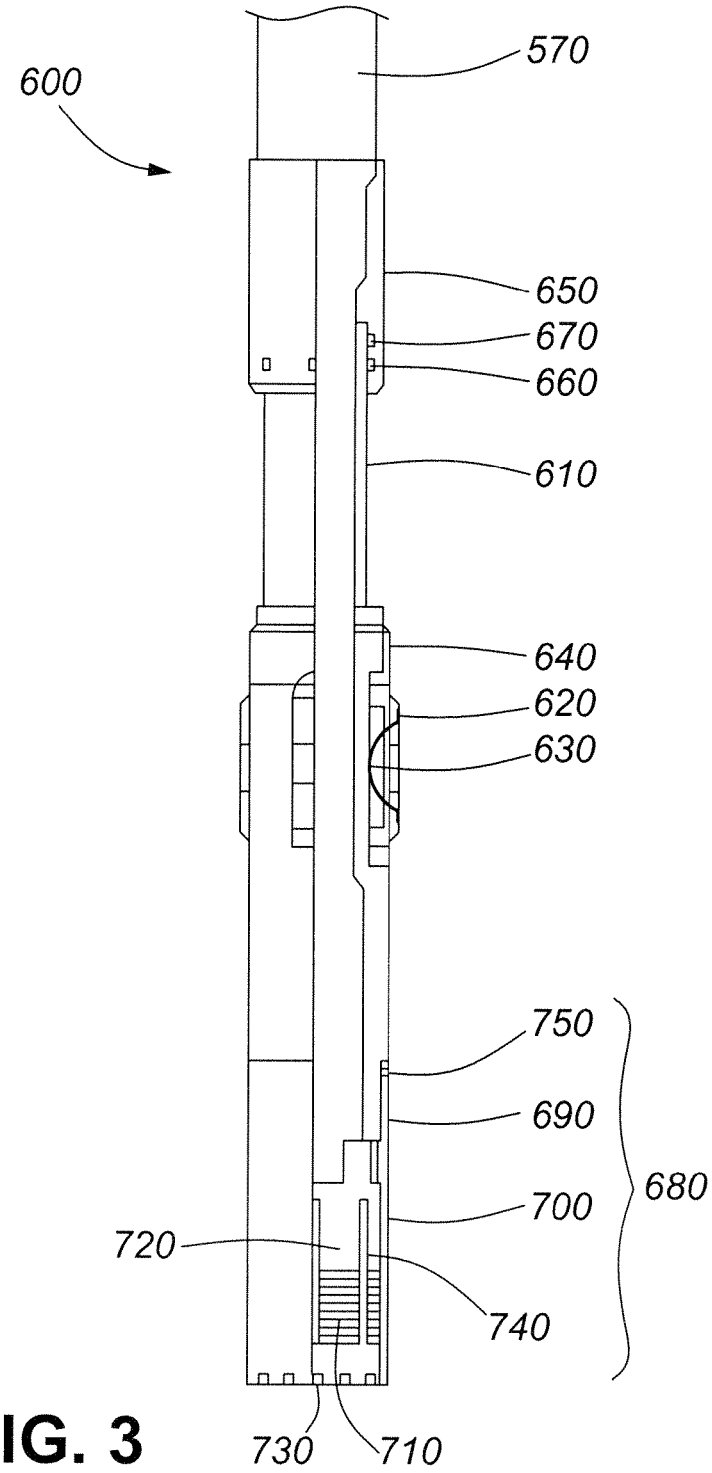
FIG. 3 is a retrieving tool of the present disclosure.
Figure 4:
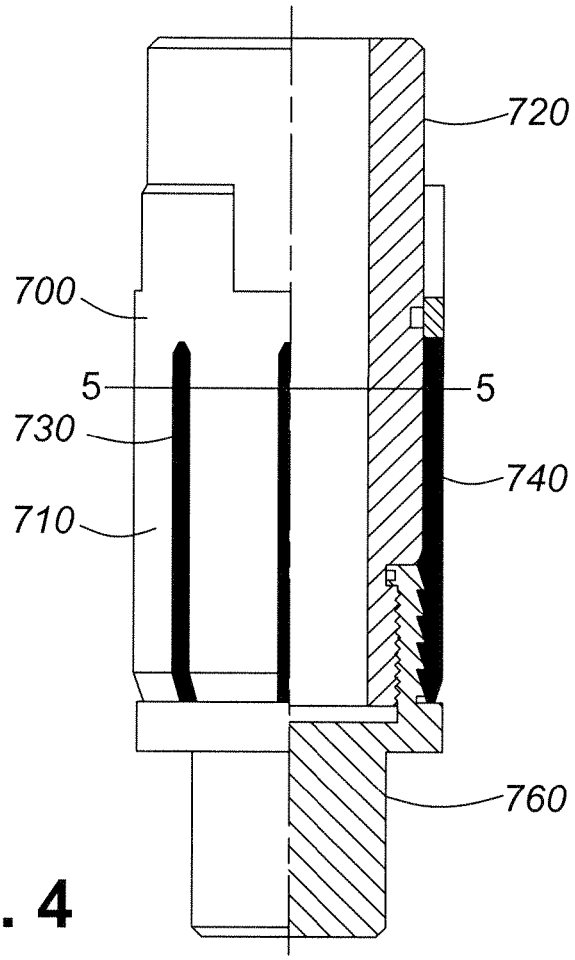
FIG. 4 is an enlarged portion of the retrieving tool of FIG. 3.
Figure 5:
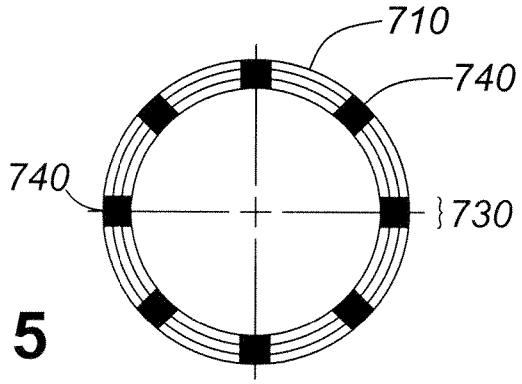
FIG. 5 is a bottom view of FIG. 4, along the section 5-5.

Referring to FIGS. 3, 4, and 5, a disclosed retrieving tool 600 includes a drag block housing 610, housing drag blocks 620 activated by drag block springs 630, held in place by a drag block retainer 640. A shear sub 650 serves to connect the drag block housing 610 and a work string 570, such as coiled tubing. A shear screw 660 pins the connection between the shear sub 650 and the drag block housing 610. An o-ring 670 seals the connection between the shear sub 650 and the drag block housing 610. In an embodiment disclosed, the shear screw 660 is designed to shear upon application of about a 2000 lb shear force.

A lower end of the drag block housing 610 includes a collet mechanism 680. A collet retainer 690 and the drag block housing 610 are connected. A collet 700, having fingers 710 is received on a collet plug 720, within the collet retainer 690. Slots 730 between the fingers 710 are filled with a sealing material 740, such as an elastomeric material, for example highly saturated nitrile (HSN) or a molded rubber. A set screw 750 retains collet retainer 690 relative to the drag block housing 610.

In an embodiment disclosed, the retrieving tool 600 may include a centralizing system to align the retrieving tool 600 and the retrievable stimulation frac plug 10. In an embodiment disclosed a removable collet protector 760 (see FIG. 4) may be used to protect the retrieving tool 600 prior to use.

Figure 6:
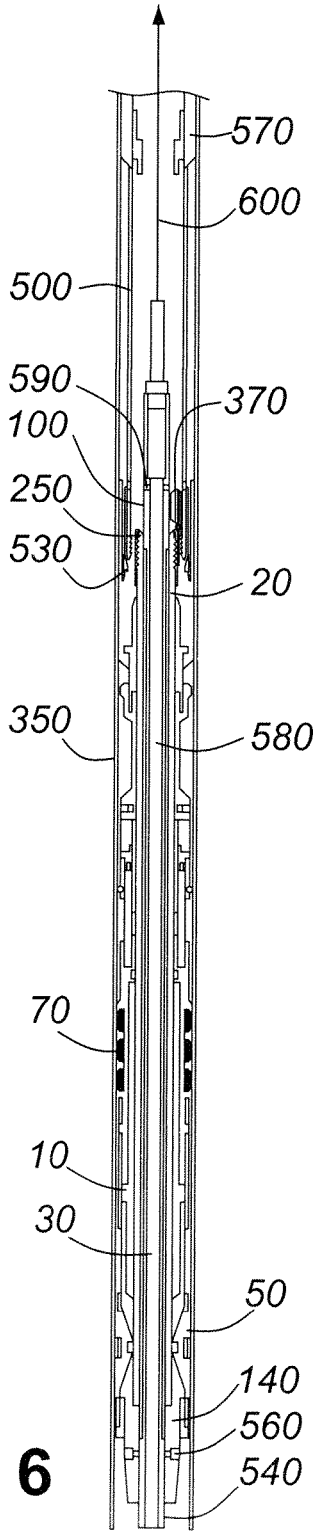
FIG. 6 is retrievable stimulation frac plug of the present disclosure depicting running the plug into the well casing.
Figure 7:
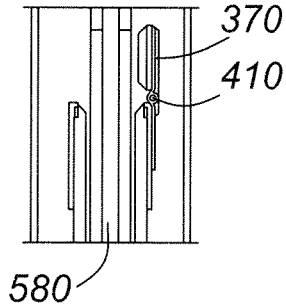
FIG. 7 is an enlarged detail of FIG. 6.

Referring to FIGS. 6 and 7, a retrievable stimulation frac plug 10 is shown being run into a wellbore casing 350 with a setting tool 500 on the working string 570 with the setting line 600.

The shear rod 540 extends through the fluid flow bore 30 of the mandrel 20 and holds the flapper 370 open, against the bias of the flapper spring 410. As the retrievable stimulation frac plug 10 is run into the casing 350, the flapper 370 is retained in the open position 100, allowing for additional fluid bypass (through the bore 580 and ports 590). When the retrievable stimulation frac plug 10 is in the desired location in the casing 350, the shear rod 540 is removed, for example by pulling upward on the connecting stud 550 with the setting line 600 such as slickline or electric line while the work string 570 is held in place. In pulling upward, the shear rod 540 pulls the lower cone 140 with it, activating the slips 50 and the sealing elements 70. When the shear screw 560 reaches its limit, the shear screw 560 breaks, releasing the shear rod 540 from the retrievable stimulation frac plug 10. The retrievable stimulation frac plug 10 is thus locked axially in place with the slips 50 and sealing elements 70 within the casing 350 form a barrier or plug between the portion of the casing 350 below the retrievable stimulation frac plug 10 and the portion of the casing 350 above the retrievable stimulation frac plug 10. In an embodiment disclosed, the shear screw 560 is designed to shear upon application of about a 2000 lb shear force. Once the retrievable stimulation frac plug 10 is set in place, the work string 570 can be pulled, leaving the frac plug 10 in place.

Referring to FIGS. 8 and 9, the retrievable stimulation frac plug 10 is shown run and set in place within the wellbore casing 350. The flapper 370 is biased into the closed position 110 by the flapper spring 410. The sealing element 90 sealingly engages a seat 95. Any production (or pressure) from below the retrievable stimulation frac plug 10 may pass through the fluid flow bore 30 of the retrievable stimulation frac plug 10 because the production will force the flapper 370 at least partially open, allowing fluids to pass (see FIGS. 10 and 11). However, pressure above the retrievable stimulation frac plug 10 instead, for example stimulation operations above the retrievable stimulation frac plug 10 will not force the flapper 370 into the open position 110 (FIGS. 10, 11), and in fact will ensure the flapper 370 remains in the closed position 110.

Figure 10:
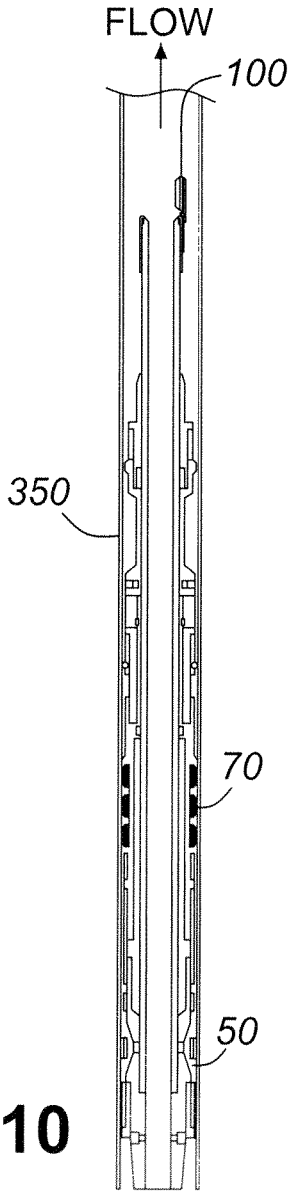
FIG. 10 is retrievable stimulation frac plug of the present disclosure depicting the plug set in place.
Figure 11:
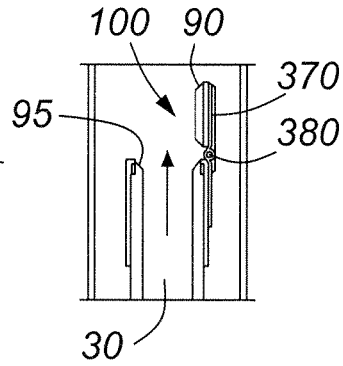
FIG. 11 is an enlarged detail of FIG. 10.

Referring to FIGS. 10 and 11, the retrievable stimulation frac plug 10 is shown run and set in place within the wellbore casing 350. Any production (or pressure) from below the retrievable stimulation frac plug 10 may pass through the fluid flow bore 30 of the mandrel 20, as the flow forces the flapper 370 at least partially out of the closed position 110, towards the open position 100, against the bias of the flapper spring 410, allowing flow upwards past the retrievable stimulation frac plug 10. The sealing element 90 does not sealingly engage the seat 95. The flapper 370 is opened by bottom hole pressure, either oil or gas flowing through. The flapper 370 closes as soon as the flow is stopped or stimulation work is started above. This procedure may be repeated any number of times as required with additional upper zones and setting additional retrievable stimulation frac plugs 10 (see FIGS. 22, 23).

Figure 12:
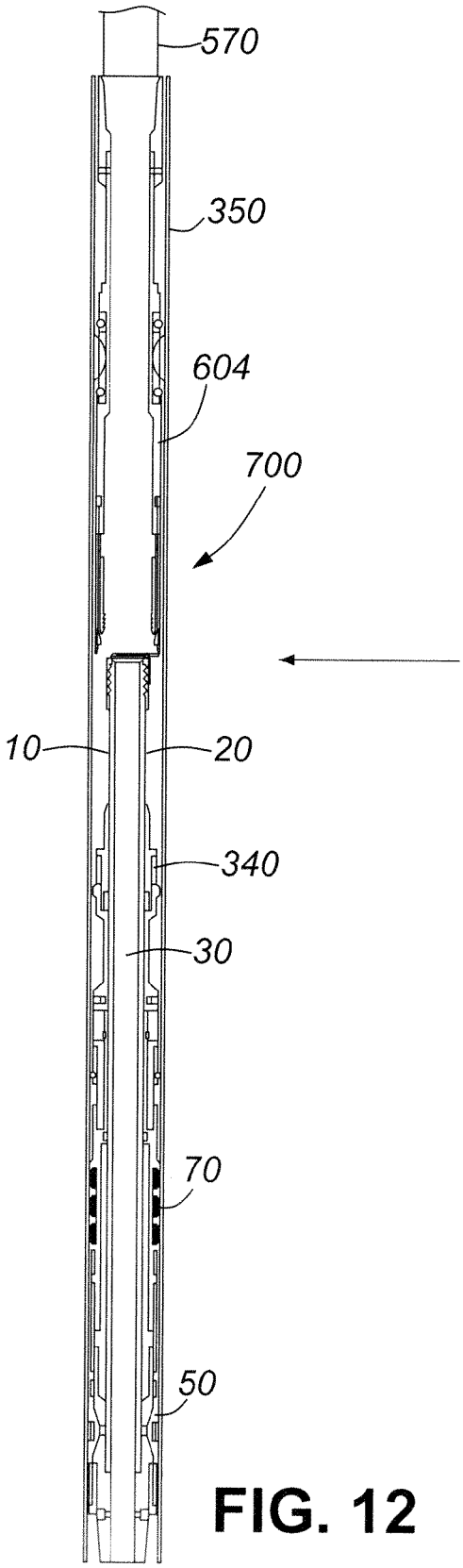
FIG. 12 is a retrievable stimulation frac plug of the present disclosure depicting releasing and retrieving the plug.
Figure 13:
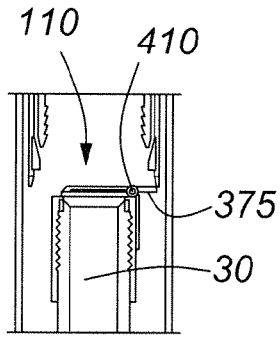
FIG. 13 is an enlarged detail of FIG. 12.
Figure 19:
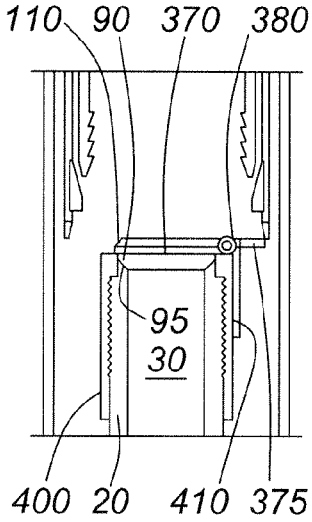
FIG. 19 is an enlarged detail of FIG. 12.

Referring to FIGS. 12, 13, and 19 the retrievable stimulation frac plug 10 is shown just prior to retrieval with a retrieving tool 604 on a work string 570, such as a CT string. The retrievable stimulation frac plug 10 is shown run and set in place in the casing 350. The slips 50 are engaged and gripping the casing 350. The sealing elements 70 are sealing the annular space between the mandrel 20 and the casing 350. One typical problem with conventional retrievable bridge plugs is that debris or other materials may accumulate on the top of the plug, which may make it difficult or even impossible to latch onto the plug for retrieval. In an embodiment disclosed, as the retrieving tool 604 is deployed in the casing 350, fluids may be circulated through the retrieving tool 604 to wash or flush away any debris or materials, such as frac sand or proppant or other debris, which may have accumulated on top of the retrievable stimulation frac plug 10, for example above the deflector 340. The defector 340 reduces or eliminates the accumulation of debris or materials in the annular space between the retrievable stimulation frac plug 10 and the casing 350.

Figure 14:
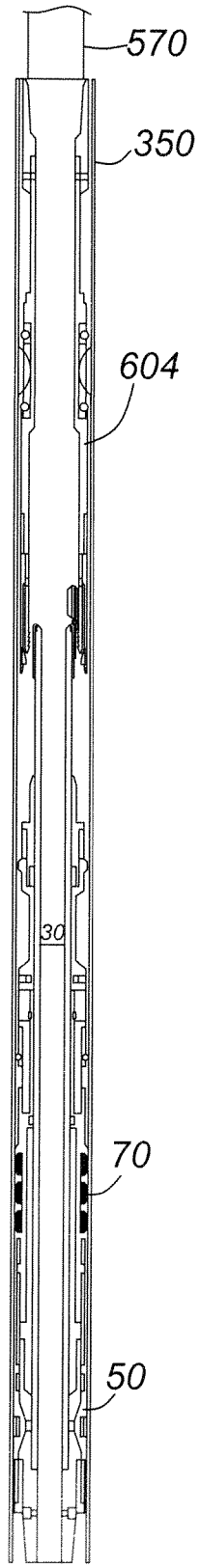
FIG. 14 is a retrievable stimulation frac plug of the present disclosure depicting releasing and retrieving the plug.
Figure 15:
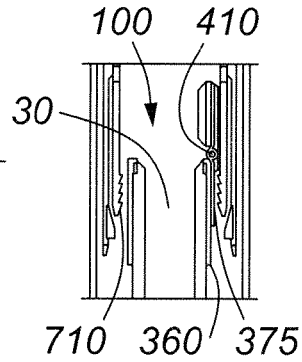
FIG. 15 is an enlarged detail of FIG. 14.
Figure 20:
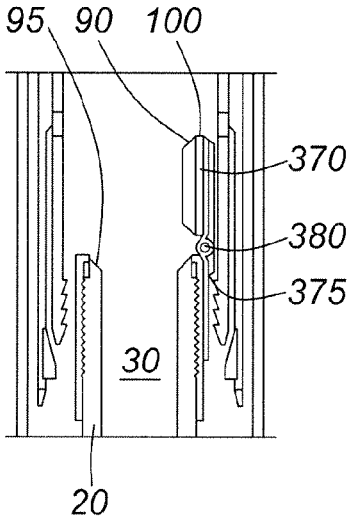
FIG. 20 is an enlarged detail of FIG. 14.

Referring to FIGS. 14, 15, and 20, as the retrieving tool 604 reaches the retrievable stimulation frac plug 10, the retrieving tool 604 engages a mechanical over-ride, in the form of an extended lip 375 of the flapper 370 to overcome the bias of the flapper spring 410, and moves the flapper 370 into the open position 100. The extended lip 375 is sandwiched between the flapper seal 360 and the fingers 710 and sealing material 740 of the collet 700 of the retrieving tool 604, holding the flapper 370 in the open position 100.

Figure 16:
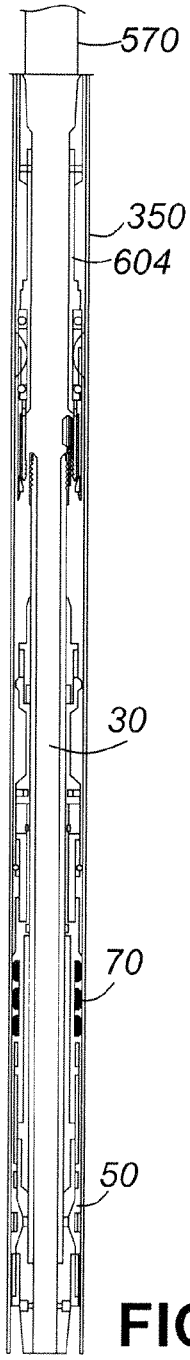
FIG. 16 is a retrievable stimulation frac plug of the present disclosure depicting releasing and retrieving the plug.
Figure 17:
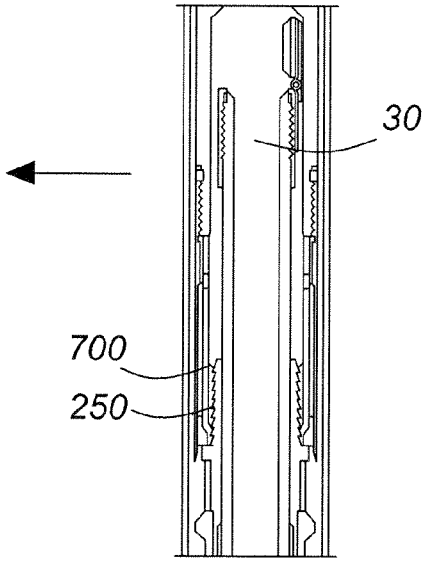
FIG. 17 is an enlarged detail of FIG. 16.
Figure 21:
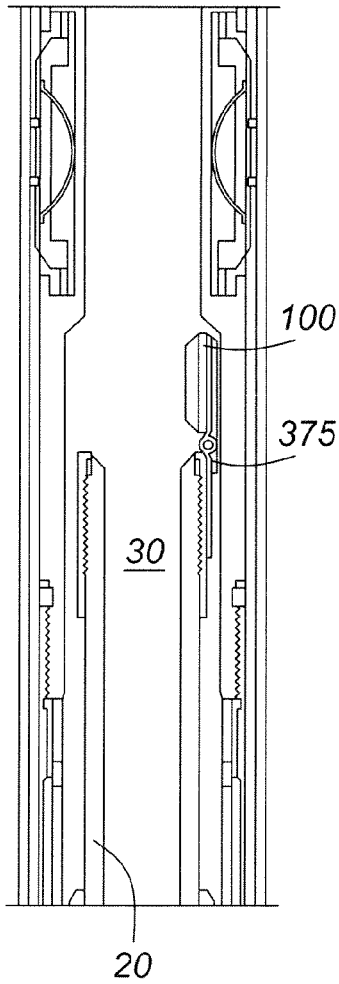
FIG. 21 is an enlarged detail of FIG. 16.

Referring to FIGS. 16, 17, and 21, the retrieving tool 604 is run further until the collet 700 of the retrieving tool 604 engages the catch 250 of the retrievable stimulation frac plug 10. In an embodiment disclosed, the retrieving tool 604 is sealingly latched onto the retrievable stimulation frac plug 10. A hydraulic seal is formed between the collet 700 having fingers 710 with sealing material 740 filling the slots 730 and the latch 250. Fluids circulated through the work string 570 will circulate through the fluid flow bore 30 of the mandrel 20 and the outside of the retrievable stimulation frac plug 10. This allows circulation of fluids below the retrievable stimulation frac plug 10, for example to wash a latch of a tool below, for example a further retrievable stimulation frac plug. In addition, the circulation of fluid up, through the annular space between the retrievable stimulation frac plug 10 and the casing 350 helps wash out any debris or other materials that may have accumulated, facilitating retrieval of the retrievable stimulation frac plug 10.

Figure 18:
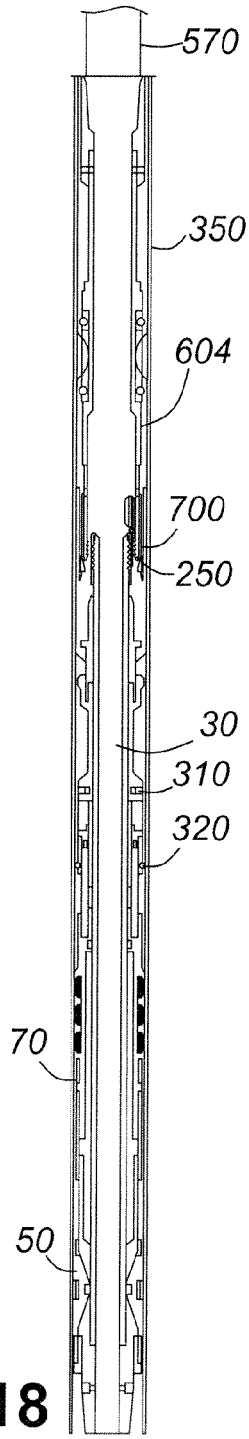
FIG. 18 is a retrievable stimulation frac plug of the present disclosure depicting retrieving the plug.

Referring to FIG. 18, with the catch 250 of the retrievable stimulation frac plug 10 held within the collet 700 of the retrieving tool 604, upward force, for example by pulling upward on the retrieval tool 604 with the work string 570 will cause the shear screw 310 and the shear screw 320 to shear, thus respectively releasing the sealing elements 70 and the slips 50. The retrievable stimulation frac plug 10 is then free to move with the work string 570 and may be retrieved upward with the retrieving tool 604 and removed from the casing 350.

Figure 22:
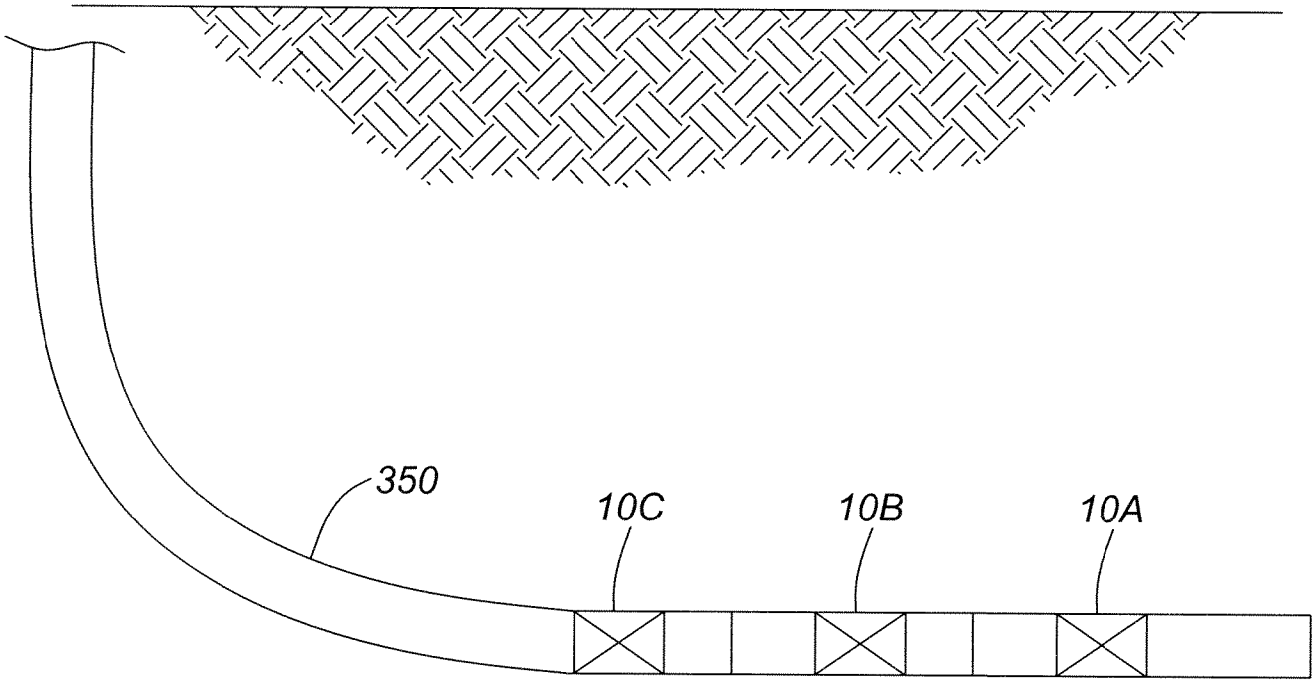
FIG. 22 is a retrievable stimulation frac plug of the present disclosure depicting a plurality of plugs deployed in a casing.

Referring to FIG. 22, in an embodiment disclosed, a plurality of retrievable stimulation frac plugs 10 may be run in sequence, for example, for a stimulation operation where a number of separate intervals or zones require isolation or stimulation or both.

As an example only, utilizing three (3) retrievable stimulation frac plugs 10, a first retrievable stimulation frac plug 10A may be run in and set within the casing 350 as described above. A first stimulation operation may be conducted above the first retrievable stimulation frac plug 10A, isolated from the casing 350 below the first retrievable stimulation frac plug 10A. A second retrievable stimulation frac plug 10B may be run in and set within the casing 350 above the first retrievable stimulation frac plug 10A. A second stimulation operation may be conducted above the second retrievable stimulation frac plug 10B, isolated from the casing 350 below the second retrievable stimulation frac plug 10B. A third retrievable stimulation frac plug 10C may be run in and set within the casing 350 above the second retrievable stimulation frac plug 10B. A third stimulation operation may be conducted above the third retrievable stimulation frac plug 10C, isolated from the casing below the third retrievable stimulation frac plug 100.

While, in this example there are three retrievable stimulation frac plugs, it is merely an example. Any number of retrievable stimulation frac plugs may be run. In an embodiment disclosed, an unlimited number of retrievable stimulation frac plugs may be run and retrieved in the same well.

Subsequently, each of the third retrievable stimulation frac plug 10C, second retrievable stimulation frac plug 10B, and first retrievable stimulation frac plug 10A may be retrieved, one at a time (i.e. one per trip), utilizing a retrieving tool 604 as described above. While, in this example there are three retrievable stimulation frac plugs, that is merely an example. Any number of retrievable stimulation frac plugs may be run. In an embodiment disclosed, an unlimited number of retrievable stimulation frac plugs may be run and retrieved in the same well.

However, in an embodiment disclosed, the third retrievable stimulation frac plug 10C, second retrievable stimulation frac plug 10B, and first retrievable stimulation frac plug 10A may be retrieved in a single trip, as follows.

Figure 23:
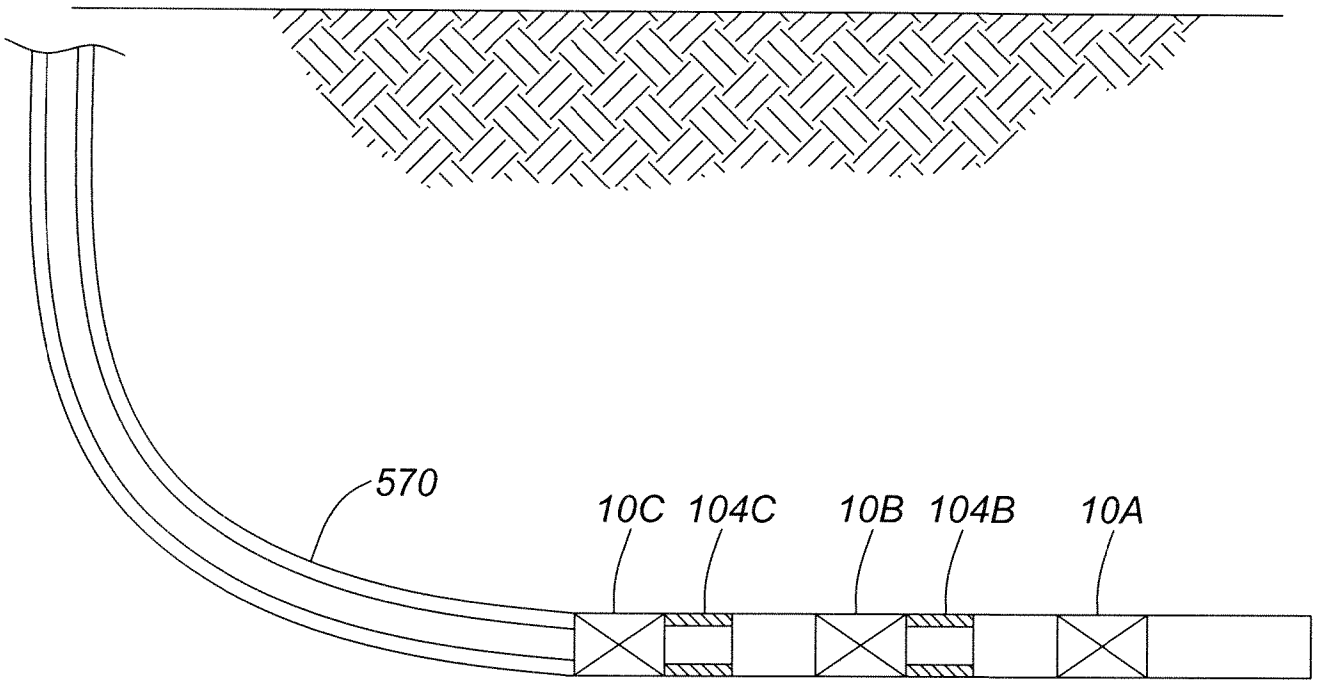
FIG. 23 is a retrievable stimulation frac plug of the present disclosure depicting a plurality of plugs deployed in a casing for retrieving in a single trip.

Referring to FIG. 23, after the first retrievable stimulation frac plug 10A is run in and set, the second retrievable stimulation frac plug 10B is run in and set with a second retrieving tool 604B attached below the second retrievable stimulation frac plug 10B. The third retrievable stimulation frac plug 10C is run in and set with a third retrieving tool 604C attached below the third retrievable stimulation frac plug 10C.

Once the stimulation operations are complete, the third retrievable stimulation frac plug 100 may be latched onto and released as described above. Once the third retrievable stimulation frac plug 100 is released, the work string 570, with the third retrievable stimulation frac plug 10C and third retrieving tool 604C attached is deployed further into the casing 350 to latch onto and release the second retrievable stimulation frac plug 10B. Once the second retrievable stimulation frac plug 10B is released, the work string 570, now with the third retrievable stimulation frac plug 100 and third retrieving tool attached 604C, and with the second retrievable stimulation frac plug 10B and the second retrieving tool 604B attached, is deployed further into the casing to latch onto and release the first retrievable stimulation frac plug 10A. Once the first retrievable stimulation frac plug 10A is released, the work string 570 now with the third retrievable stimulation frac plug 10C (and third retrieving tool 604C), the second retrievable stimulation frac plug 10B (and the second retrieving tool 604B), and the first retrievable stimulation frac plug 10A attached, may be pulled from the casing 350. Thus, a plurality, in this example three (3), retrievable stimulation frac plugs 10 may be pulled in a single run. While, in this example there are three retrievable stimulation frac plugs, that number is merely an example. Any number of retrievable stimulation frac plugs may be run. In an embodiment disclosed, an unlimited number of retrievable stimulation frac plugs may be run and retrieved in the same well.

The time and expense savings are self evident, particularly as the number of retrievable stimulation frac plugs 10 increases. In the example of three (3) frac plugs, two (2) trips are saved. If the number of frac plugs was instead ten (10), fifteen (15), or for example fifty (50), the number of trips saved may be nine (9), fourteen (14), or forty-nine (49) respectively, resulting in decreased time and therefore reduced equipment and labour costs.

In an embodiment disclosed, where the plurality of retrievable stimulation frac plugs to be retrieved becomes large, for example fifty (50) or more, they need not all be retrieved at the same time, and may instead be retrieved in convenient groups, for example, groups of 5, 10, 20, etc. as the case may be.

In the preceding description, for purposes of explanation, numerous details are set forth in order to provide a thorough understanding of the embodiments. However, it will be apparent to one skilled in the art that these specific details are not required. In other instances, well-known structures and components are shown in block diagram or simplified form in order not to obscure the understanding.

The above-described embodiments are intended to be examples only. Alterations, modifications and variations can be effected to the particular embodiments by those of skill in the art without departing from the scope, which is defined solely by the claims appended hereto.

What is claimed is:

1. A retrievable stimulation frac (RSF) plug for a well casing, comprising:

an elongate mandrel having a fluid flow bore;

a one-way check valve mandrel seal comprising a flapper, moveable between an open position and a closed position for selectively sealing the fluid flow bore, the flapper comprising an extended lip adapted to urge the flapper into the open position upon engagement with a retrieving tool;

a sealing mechanism for sealing between the mandrel and the casing; and a locking mechanism for axially locking the retrievable stimulation frac plug in the casing.

2. The retrievable stimulation frac plug of claim 1, the flapper biased toward the closed position.

3. The retrievable stimulation frac plug of claim 1, the extended lip adapted to be operable by the retrieving tool, in order to retain the flapper in the open position.

4. A retrievable stimulation frac (RSF) plug for a well casing, comprising:

an elongate mandrel having a fluid flow bore;

a one-way check valve mandrel seal moveable between an open position and a closed position for selectively sealing the fluid flow bore;

a sealing mechanism for sealing between the mandrel and the casing;

a locking mechanism for axially locking the retrievable stimulation frac plug in the casing; and a setting tool, the setting tool comprising a shear rod extending through the fluid flow bore, retaining the mandrel seal in the open position, and a shear pin connecting the shear rod and a lower cone of the retrievable stimulation frac plug.

5. A method of stimulating a well having casing, comprising:

providing a retrievable stimulation frac plug having an elongate mandrel with a fluid flow bore, the fluid flow bore sealable with a one-way check valve mandrel seal comprising a flapper, moveable between an open position and a closed position for selectively sealing the fluid flow bore and biased to the closed position, the flapper comprising an extended lip adapted to urge the flapper into the open position upon engagement with a retrieving tool;

selectively moving the check valve into the open position;

deploying the retrievable stimulation frac plug into the casing; and conducting a well operation.

6. The method of claim 5, the well operation comprising producing fluids from below the retrievable stimulation frac plug through the fluid flow bore, the check valve forced at least partially from the closed position by the fluids.

7. The method of claim 5, the well operation comprising frac-stimulation of the well above the retrievable stimulation frac plug, the check valve retained in the closed position by the frac-stimulation.

8. The method of claim 5, further comprising retrieving the retrievable stimulation frac plug after conducting the well operation.

9. The method of claim 8, further comprising circulating fluids proximate an upper end of the retrievable stimulation frac plug prior to retrieving the retrievable stimulation frac plug.

10. The method of claim 5, further comprising:

providing a second retrievable stimulation frac plug having a second elongate mandrel with a second fluid flow bore, the second fluid flow bore sealable with a second one-way check valve mandrel seal comprising a second flapper, moveable between an open position and a closed position for selectively sealing the second fluid flow bore and biased to the closed position, the second flapper comprising an extended lip adapted to urge the second flapper into the open position upon engagement with a retrieving tool;

providing a retrieving tool, attached below the second retrievable stimulation frac plug;

selectively moving the second one-way check valve into the open position;

deploying the second retrievable stimulation frac plug into the casing, above the retrievable stimulation frac plug; and conducting a second well operation.

11. The method of claim 10, further comprising:

providing a retrieving tool on a work string;

deploying the retrieving tool into the well to latch onto the second retrievable stimulation frac plug;

releasing the second retrievable stimulation frac plug from the casing;

further deploying the retrieving tool into the well, with second retrievable stimulation frac plug and second retrieving tool attached to latch onto the retrievable stimulation frac plug;

releasing the retrievable stimulation frac plug from the casing; and pulling the work string from the well, with the second retrievable stimulation frac plug and the retrievable stimulation frac plug attached, in a single run.

12. A method of stimulating a well having casing, comprising:

providing a retrievable stimulation frac plug having an elongate mandrel with a fluid flow bore, the fluid flow bore sealable with a one-way check valve mandrel seal moveable between an open position and a closed position for selectively sealing the fluid flow bore; and biased to the closed position, the flapper comprising an extended lip adapted to urge the flapper into the open position upon engagement with a retrieving tool, the retrievable stimulation frac plug further comprising a setting tool, the setting tool comprising a shear rod extending through the fluid flow bore, retaining the mandrel seal in the open position, and a shear pin connecting the shear rod and a lower cone of the retrievable stimulation frac plug;

selectively moving the check valve into the open position;

deploying the retrievable stimulation frac plug into the casing;

pulling the setting tool from the retrievable stimulation frac plug; and conducting a well operation to stimulate the well.

* * * * *